US005604950A

United States Patent [19]

Stern

[11] Patent Number: 5,604,950

[45] Date of Patent: Feb. 25, 1997

[54] ANTI-CLOGGING, VARIABLE THROAT SUCTION NOZZLE AND SUCTION CLEANING DEVICE EQUIPPED THEREWITH

[75] Inventor: Carl M. Stern, Pennington, N.J.

[73] Assignee: H-Tech, Inc., Wilmington, Del.

[21] Appl. No.: 549,047

[22] Filed: Oct. 27, 1995

[51] Int. Cl.[6] ..... E04H 4/16; A47L 9/02

[52] U.S. Cl. ..... 15/1.7; 15/415.1; 15/418

[58] Field of Search ..... 15/1.7, 415.1, 15/418–421

[56] References Cited

U.S. PATENT DOCUMENTS

| | | | |
|---|---|---|---|
| 1,050,989 | 1/1913 | Niuffer . | |
| 1,101,541 | 6/1914 | Harrington . | |
| 1,869,200 | 7/1932 | Linton . | |
| 2,534,189 | 12/1950 | Wright . | |
| 3,085,267 | 4/1963 | Jacuzzi | 15/1.7 |
| 3,862,469 | 1/1975 | Burgoon | 15/418 X |
| 3,949,442 | 4/1976 | Chandler | 15/1.7 |
| 4,317,243 | 3/1982 | Chauvier . | |
| 4,656,683 | 4/1987 | Raubenheimer | 15/1.7 |
| 4,692,956 | 9/1987 | Kassis | 15/1.7 |
| 5,105,496 | 4/1992 | Gray, Jr. et al. | 15/1.7 |
| 5,285,547 | 2/1994 | Sebor | 15/1.7 |

FOREIGN PATENT DOCUMENTS

| | | | |
|---|---|---|---|
| 1186817 | 4/1970 | United Kingdom | 15/418 |
| 1590623 | 6/1981 | United Kingdom | 15/1.7 |

*Primary Examiner*—Mark Spisich
*Attorney, Agent, or Firm*—Selitto & Associates

[57] ABSTRACT

A suction nozzle adapted for use in a suction cleaning device, such as an automatic swimming pool cleaner, includes a body having a throat extending from an inlet at one end of the body to an outlet at an opposite end of the body. The body itself is split longitudinally into a plurality of discrete body portions to form the throat of the nozzle. One body portion is movable relative to the other body portion, whereby the throat automatically expands in response to the relative movement of the body portions. The resulting expansion of the nozzle allows substantially unrestricted passage of large foreign objects through the throat during the operation of the suction cleaning device.

22 Claims, 4 Drawing Sheets

ANTI-CLOGGING, VARIABLE THROAT SUCTION NOZZLE AND SUCTION CLEANING DEVICE EQUIPPED THEREWITH

FIELD OF THE INVENTION

The present invention relates to suction nozzles, and, more particularly, to suction nozzles especially adapted for use in connection with an automatic suction-type swimming pool cleaner.

BACKGROUND OF THE INVENTION

Various automatic suction-type swimming pool cleaners have been developed in the past. For instance, U.S. Pat. No. 5,105,496 discloses a swimming pool cleaner having a primary fluid flow path, which extends from a primary inlet to a primary outlet, and a pair of secondary fluid flow paths, which extends from secondary inlets to secondary outlets. The swimming pool cleaner is also provided with a primary turbine mounted in the primary flow path for driving the swimming pool cleaner and a pair of secondary turbines mounted in the secondary flow path for steering the swimming pool cleaner. In addition, the swimming pool cleaner includes a suction nozzle having a throat, which extends from the primary inlet toward the primary turbine. As water flows into the primary flow path in response to the operation of an associated suction source (e.g., a pump) connected to the primary outlet, the suction nozzle functions to direct the water toward the primary turbine. As a result, the primary turbine is caused to rotate, thereby driving the swimming pool cleaner.

A special problem is presented when large objects flow into the suction nozzle during the operation of the swimming pool cleaner. More particularly, large objects become trapped in the throat of the suction nozzle, thereby obstructing same. Such an obstruction significantly restricts water flow through the throat of the suction nozzle, and, as a result, causes undue stress on the associated suction source and inefficient operation of the swimming pool cleaner.

U.S. Pat. No. 4,656,683 specifically addresses the foregoing problem by providing a suction cleaning apparatus with a suction nozzle which is made of a resiliently deformable material (e.g., silicone rubber) such that the suction nozzle can expand from a normal state to an expanded state in order to allow large objects to pass therethrough. However, because of the inherent resiliency of the deformable material, the suction nozzle tends to conform to the shape of large objects as they expand the suction nozzle, whereby the suction nozzle walls embrace the objects so as to impede their passage through the suction nozzle. As a result, some larger objects may actually become trapped in the suction nozzle, thereby causing an obstruction.

SUMMARY OF THE INVENTION

The present invention overcomes the disadvantages and shortcomings of the prior art discussed above by providing a new and improved suction nozzle adapted for use in an automatic suction-type swimming pool cleaner. More particularly, the suction nozzle includes a body which is split longitudinally into a plurality of discrete body portions cooperating to form a throat which tapers from an inlet at one end of the body to an outlet at an opposite end of the body. At least one body portion is movable relative to another body portion, whereby the throat automatically expands in response to the relative movement of the body portions. The resulting expansion of the suction nozzle allows substantially unrestricted passage of large foreign objects through the throat during the operation the cleaner.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENT

Although the present invention is applicable to many different types of devices equipped with suction nozzles, it is especially suitable for use in connection with an automatic suction-type swimming pool cleaner powered by a turbine. Accordingly, the present invention will be described in connection with an exemplary embodiment of such a swimming pool cleaner. It should be understood, however, that the following description is only meant to be illustrative of the present invention and is not meant to limit the scope of the present invention, which has applicability to other types of devices equipped with suction nozzles.

Figure 2:
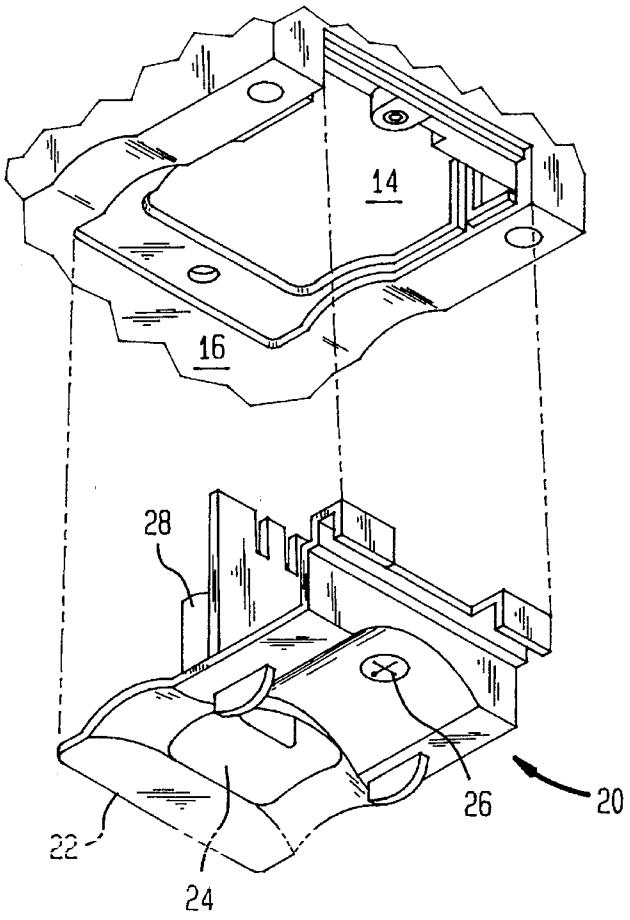
FIG. 2 is an enlarged exploded perspective view, looking from below, of a portion of the swimming pool cleaner illustrated in FIG. 1.
Figure 1:
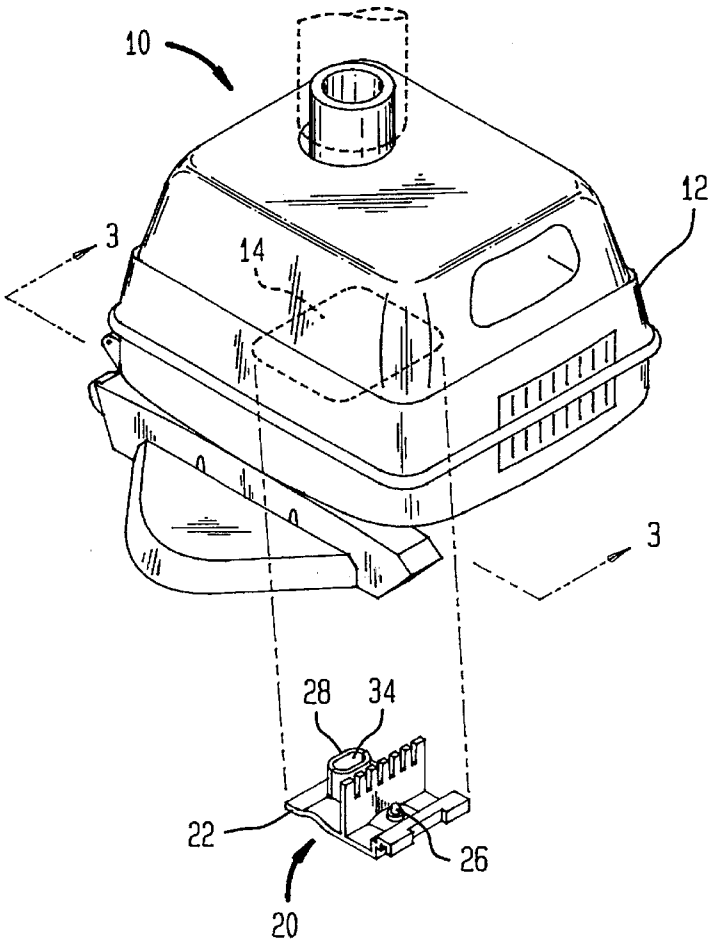
FIG. 1 is an exploded perspective view of an automatic suction-type swimming pool cleaner equipped with a removable door, which includes a suction nozzle constructed in accordance with the present invention.
Figure 3:
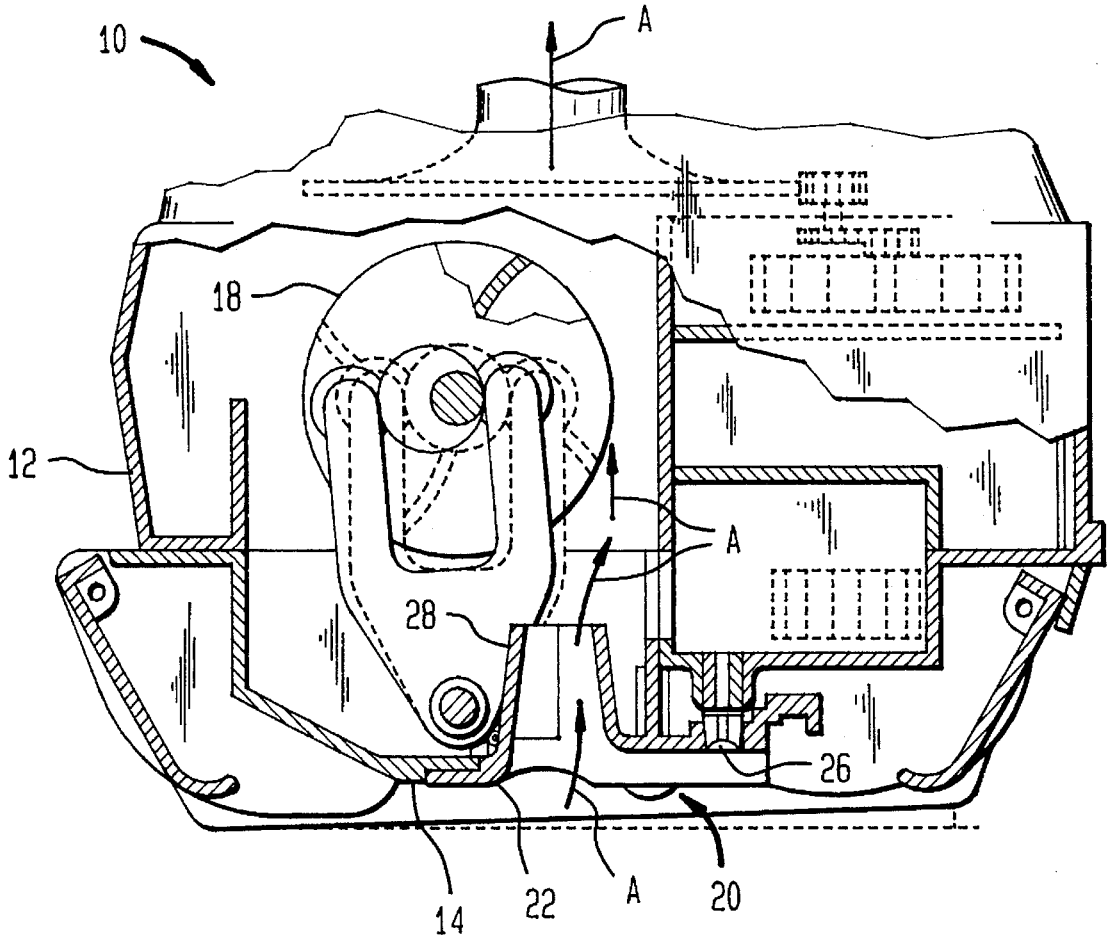
FIG. 3 is a partial cross-sectional view, taken along section line 3—3 and looking in the direction of the arrows, of the swimming pool cleaner illustrated in FIG. 1.

FIGS. 1 and 3 show an automatic swimming pool cleaner 10 of a type disclosed in U.S. Pat. No. 5,105,496, which is incorporated herein by reference. More particularly, the swimming pool cleaner 10 includes a housing 12 having a primary fluid flow path (indicated by arrows A in FIG. 3), which extends through the housing 12 for allowing passage of water through the swimming pool cleaner 10. Further, an opening 14 is provided in a bottom wall 16 of the housing 12 (see FIGS. 1 and 2), while a turbine 18 is mounted in the primary flow path such that water flowing through the primary flow path causes the turbine 18 to rotate so as to drive the swimming pool cleaner 10.

With reference to FIGS. 1–3, the swimming pool cleaner 10 also includes a removable door 20 received in the opening 14. More particularly, the door 20 has a base 22 and a capture screw 26 mounted on the base 22 so as to removably mount the door 20 in the opening 14 of the housing 12.

Figure 4:
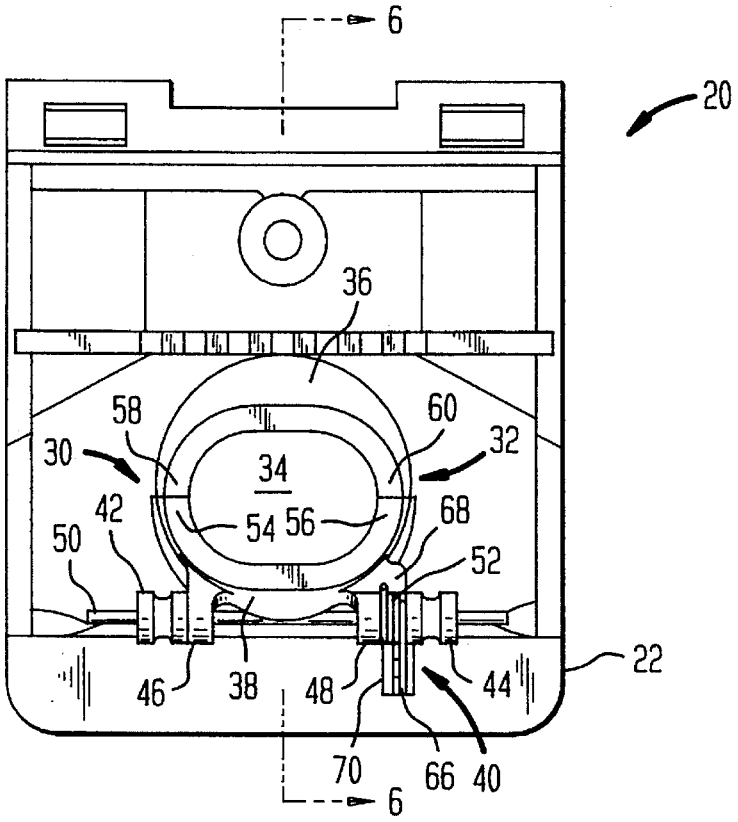
FIG. 4 is a top plan view of the removable door illustrated in FIGS. 1–3.
Figure 5:
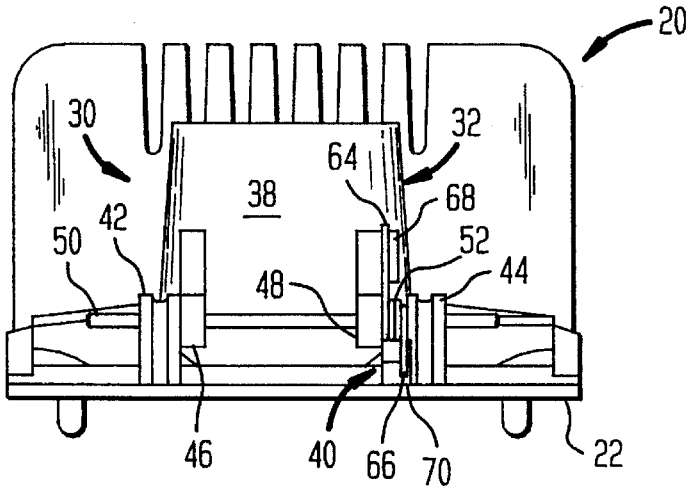
FIG. 5 is an elevational view of the removable door illustrated in FIGS. 1–4.

Referring to FIGS. 1–3, the door 20 also includes a suction nozzle 28 projecting from the base 22 of the door 20. More particularly and with reference to FIGS. 4–6, the suction nozzle 28 is defined by a tubular frustum-shaped body 30 having a throat 32 extending between an inlet 24 (see FIGS. 2 and 6), which is formed in the base 22, and an outlet 34 having a diameter, which is smaller than that of the inlet 24, and communicating with the primary flow path (see FIG. 3). The body 30 is split longitudinally into a stationary member 36 and a movable gate member 38. The stationary member 36 is integrally and thereby immovably mounted on the base 22 adjacent to the inlet 24, while the gate member 38 is pivotally mounted on the base 22 adjacent to the inlet 24 through the use of a hinge 40 positioned opposite the stationary member 36.

The hinge 40 includes a pair of bearings 42, 44, which project from the base 22, and a pair of pivot arms 46, 48, which extend from a bottom portion of the gate member 38 and which are positioned between the bearings 42, 44. A pin 50 extends through the bearings 42, 44 and the pivot arms 46, 48 so as to allow the gate member 38 to pivot toward and away from the stationary member 36. A torsion spring 52 is mounted on a guide (not shown), which extends from the pivot arm 48 toward the bearing 44, for urging the gate member 38 into its normal "rest" position, in which the gate member 38 is biased against the stationary member 36 (see FIGS. 4 and 6) such that laterally opposed sides 54, 56 of the gate member 38 are in contact with laterally opposed sides 58, 60, respectively, of the stationary member 36 along the entire length thereof and such that a bottom edge 62 (see FIG. 6) of the gate member 38 is in contact with the base 22 along the entirety of the bottom edge 62. Legs 64, 66 of the torsion spring 52 bear against bearings 68, 70, respectively, which are formed on the gate member 38 and the base 22, respectively (see FIGS. 4 and 5).

During the operation of the swimming pool cleaner 10, water flows into the primary flow path through the throat 32 of the suction nozzle 28 in response to the operation of an associated suction source, such as a pump (not shown). The outlet 34, because of its smaller diameter, facilitates in creating sufficient vacuum force for sucking in foreign objects adjacent to the inlet 24 into the swimming pool cleaner 10 and in concentrating water flow toward the turbine 18 for producing sufficient driving power. The inlet 24 facilitates in creating a funneling effect so as to direct foreign objects toward the throat 32.

Figure 6:
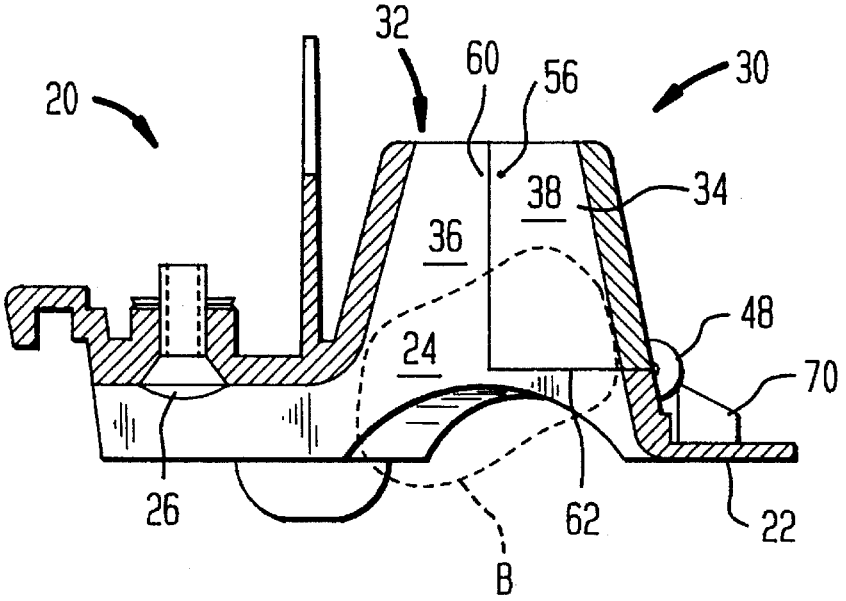
FIG. 6 is a cross-sectional view, taken along section line 6—6 and looking in the direction of the arrows, of the removable door illustrated in FIG. 4, the suction nozzle being shown in a rest position.
Figure 7:
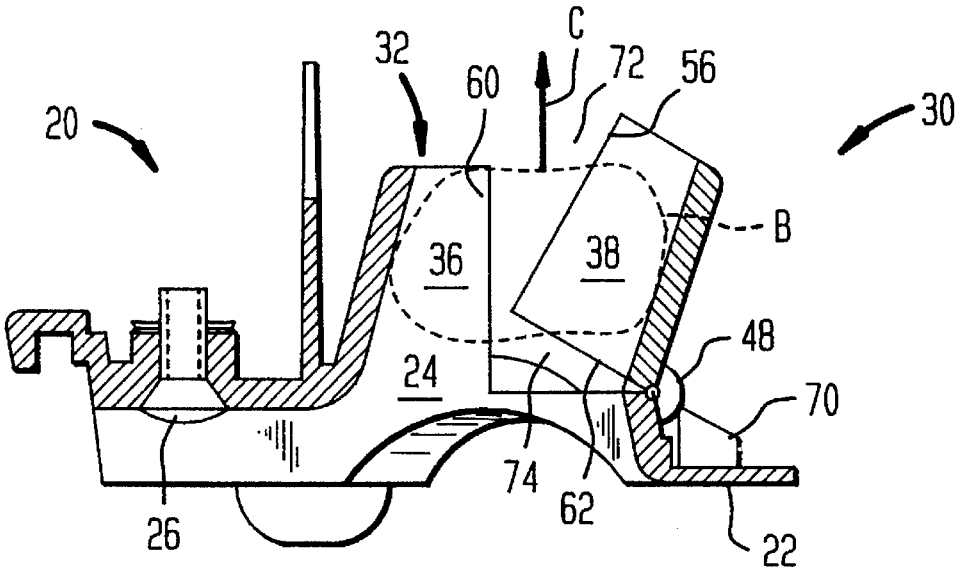
FIG. 7 is a cross-sectional view of the removable door illustrated in FIG. 6, the suction nozzle being shown in an expanded position.

Referring to FIGS. 6 and 7, during normal operation, the suction nozzle 28 is generally in its rest position (see FIG. 6). As a large foreign object B (indicated by a broken line representation in FIGS. 6 and 7) is sucked into the inlet 24, the throat 32 of the suction nozzle 28 automatically expands. More particularly, the foreign object B causes the gate member 38 to pivot away from the stationary member 36. As a result, the throat 32 of the suction nozzle 28 expands and is thereby enlarged so as to allow for the substantially unrestricted passage of the foreign object B.

It should be noted that the suction nozzle 28 provides numerous advantages over conventional suction nozzles. For instance, because the throat 32 of the suction nozzle 28 automatically expands, large objects freely pass through the suction nozzle 28 without restriction. In addition, the gate member 38 functions to urge the large objects present in the throat 32 toward the outlet 34 and, as a result, facilitates in the expulsion (as indicated by an arrow C in FIG. 7) of large foreign objects from the suction nozzle 28. Further, in its expanded position, in which the gate member 38 is moved away from the stationary member 36, V-shaped openings 72 (only one of which is shown in FIG. 7) are formed between the laterally opposed sides 58, 60 of the stationary member 36 and the laterally opposed sides 54, 56, respectively, of the gate member 38, while a slot 74 is formed between the bottom edge 62 of the gate member 38 and the base 22 (see FIG. 7). Because the openings 72 extend along the entire length of the throat 32 and the slot 74 extends along the entire length of the bottom edge 62 of the gate member 38, the openings 72 and the slot 74 function to provide a bypass in the event that the throat 32 is blocked by an obstruction, whereby the flow of water through the throat 32 of the suction nozzle 28 is continuously maintained. As a result, even if the throat 32 of the suction nozzle 28 becomes obstructed, the swimming pool cleaner 10 continues to be operational and thereby minimizes undue stress on an associated suction source.

It will be understood that the embodiment described herein is merely exemplary and that a person skilled in the art may make many variations and modifications without departing from the spirit and scope of the invention. For instance, the suction nozzle 28 may be split into a plurality of movable gate members. Moreover, the suction nozzle 28 may operate without the provision of the stationary member 36. Further, the gate member 38 may be movably mounted on the base 22 of the door 20 by other conventional mechanisms. All such variations and modifications are intended to be included within the scope of the invention as defined in the appended claims.

I claim:

1. A suction nozzle adapted for use in a suction cleaning device, comprising a body which is split into a plurality of discrete body portions cooperating to define a throat which tapers from an inlet at one end of said body to an outlet at an opposite end of said body, at least one of said body portions being movable relative to another of said body portions in response to the entry into said nozzle of foreign objects which are smaller than said inlet but larger than said outlet, whereby said throat is expandable so as to facilitate the passage of foreign objects through said nozzle during the operation of an associated suction cleaning device.

2. The nozzle of claim 1, further comprising supporting means for supporting said body at said one end thereof, and mounting means for pivotally mounting said one body portion on said supporting means.

3. The nozzle of claim 2, wherein said mounting means includes a hinge which connects said one body portion to said supporting means, said hinge being positioned adjacent said one end of said body externally of said throat.

4. The nozzle of claim 3, further comprising urging means for urging said one body portion against said another body portion.

5. The nozzle of claim 4, wherein said urging means facilitates in the expulsion of foreign objects from said throat during the operation of an associated suction cleaning device.

6. The nozzle of claim 5, wherein said urging means includes a spring mounted on said hinge.

7. The nozzle of claim 2, wherein said another body portion is immovably mounted on said supporting means.

8. The nozzle of claim 1, further comprising bypass means for forming a bypass between said inlet and said outlet, whereby a continuous flow of fluid through said throat is maintained in the event that said throat is blocked by a foreign object during the operation of an associated suction cleaning device.

9. The nozzle of claim 8, wherein said bypass is formed as said one body portion moves away from said another body portion.

10. The nozzle of claim 9, wherein said one body portion and said another body portion include first and second edges, respectively, and said one body portion is movable between a first position, in which said first and second edges are in contact with one another, and a second position, in which said first and second edges are out of contact with one another; and wherein said bypass includes a first opening formed between said first and second edges when said one body portion moves toward said second position.

11. The nozzle of claim 10, further comprising supporting means for supporting said body at said one end thereof, said one body portion having a third edge, which is in contact with said supporting means when said one body portion is in its said first position and which is out of contact with said supporting means when said one body portion is in its said second position, and said bypass having a second opening which is formed between said third edge and said supporting means when said one body portion moves toward said second position.

12. In combination, a suction cleaning device having a housing; and a suction nozzle having a body, which is split into a plurality of discrete body portions cooperating to define a throat which tapers from an inlet formed in said housing at one end of said body to an outlet at an opposite end of said body, at least one of said body portions being movable relative to another of said body portions in response to the entry into said nozzle of foreign objects which are smaller than said inlet but larger than said outlet, whereby said throat is expandable so as to facilitate the passage of foreign objects through said nozzle during the operation of said suction cleaning device.

13. The combination of claim 12, further comprising mounting means for pivotally mounting said one body portion on said housing.

14. The combination of claim 13, wherein said mounting means includes a hinge which connects said one body portion to said housing, said hinge being positioned adjacent said one end of said body externally of said throat.

15. The combination of claim 14, further comprising urging means for urging said one body portion against said another body portion.

16. The combination of claim 15, wherein said urging means facilitates in the expulsion of foreign objects from said throat during the operation of said suction cleaning device.

17. The combination of claim 16, wherein said urging means includes a spring mounted on said hinge.

18. The combination of claim 13, wherein said another body portion is immovable relative to said housing.

19. The combination of claim 12, wherein said nozzle further includes bypass means for forming a bypass between said inlet and said outlet, whereby a continuous flow of fluid through said throat is maintained in the event that said throat is blocked by a foreign object during the operation of said suction cleaning device.

20. The combination of claim 19, wherein said bypass is formed as said one body portion moves away from said another body portion.

21. The combination of claim 20, wherein said one body portion and said another body portion include first and second edges, respectively, and said one body portion is movable between a first position, in which said first and second edges are in contact with one another, and a second position, in which said first and second edges are out of contact with one another; and wherein said bypass includes a first opening formed between said first and second edges when said one body portion moves toward said second position.

22. The combination of claim 21, wherein said one body portion includes a third edge which is in contact with said housing when said one body portion is in its said first position and which is out of contact with said housing when said one body portion is in its said second position; and wherein said bypass further includes a second opening formed between said third edge and said housing when said one body portion moves toward said second position.

* * * * *